US009595787B2

(12) United States Patent
Qiao et al.

(10) Patent No.: US 9,595,787 B2
(45) Date of Patent: Mar. 14, 2017

(54) LATCHING CONNECTOR ASSEMBLY

(71) Applicant: 3M INNOVATIVE PROPERTIES COMPANY, St. Paul, MN (US)

(72) Inventors: YunLong Qiao, Singapore (SG); Saujit Bandhu, Singapore (SG)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 14/353,786

(22) PCT Filed: Nov. 5, 2012

(86) PCT No.: PCT/US2012/063493

§ 371 (c)(1),
(2) Date: Apr. 24, 2014

(87) PCT Pub. No.: WO2013/077991

PCT Pub. Date: May 30, 2013

(65) Prior Publication Data

US 2014/0302694 A1 Oct. 9, 2014

Related U.S. Application Data

(60) Provisional application No. 61/563,135, filed on Nov. 23, 2011.

(51) Int. Cl.
*H01R 13/629* (2006.01)
*H01R 13/627* (2006.01)
(Continued)

(52) U.S. Cl.
CPC ..... *H01R 13/6272* (2013.01); *H01R 12/7023* (2013.01); *H01R 13/6275* (2013.01); *H01R 12/75* (2013.01)

(58) Field of Classification Search
CPC ..... H01R 13/6271; H01R 13/6272; H01R 13/6273; H01R 13/629; H01R 13/62905;
(Continued)

(56) References Cited

U.S. PATENT DOCUMENTS 4,838,808 A * 6/1989 Fujiura ..... 439/357
5,344,335 A * 9/1994 Scholz et al. ..... 439/357
(Continued)

FOREIGN PATENT DOCUMENTS

CN 201985376 U 9/2011
DE 299 23 756 3/2001
(Continued)

OTHER PUBLICATIONS

PCT International Search Report for PCT/US2012/063493 mailed on Mar. 20, 2013, 3 pages.

*Primary Examiner* — Amy Cohen Johnson
*Assistant Examiner* — Matthew T Dzierzynski
(74) *Attorney, Agent, or Firm* — Robert S. Moshrefzadeh

(57) ABSTRACT

An electrical cable connector includes a cable connector housing and a latch attached to the cable connector housing. The cable connector housing includes a first set of electrical contacts and a latch channel. The latch includes an arm portion, a hinge portion, and an actuation portion. The arm portion is disposed in the latch channel and includes a pair of latch arms. The latch arms include opposing catch portions disposed at a front end thereof and are adapted to securely attach the cable connector to a mating connector by surrounding a protrusion inside a housing of the mating connector. The hinge portion extends from a back end of the arm portion. The actuation portion extends generally upwardly from the hinge portion. Pressing down the actuation portion about the hinge portion splays the latch arms such that the catch portions are moved away from each other.

10 Claims, 7 Drawing Sheets

(51) Int. Cl.
*H01R 12/70* (2011.01)
*H01R 12/75* (2011.01)

(58) Field of Classification Search
CPC ..... H01R 13/62916; H01R 13/62933; H01R 13/62938
USPC .. 439/325, 327, 358, 345, 352, 372, 552, 78
See application file for complete search history.

(56) References Cited

U.S. PATENT DOCUMENTS

| | | | | |
|---|---|---|---|---|
| 5,538,437 | A * | 7/1996 | Bates et al. | 439/352 |
| 6,024,594 | A | 2/2000 | Self, Jr. et al. | |
| 6,422,887 | B1 | 7/2002 | Myer et al. | |
| 7,736,171 | B2 * | 6/2010 | Reed et al. | 439/352 |
| 8,062,051 | B2 * | 11/2011 | Ngo | 439/352 |
| 8,439,706 | B2 | 5/2013 | Sytsma et al. | |
| 8,616,910 | B2 * | 12/2013 | Giefers et al. | 439/358 |
| 2002/0155746 | A1 | 10/2002 | Simpson | |
| 2004/0116000 | A1 | 6/2004 | Sandoval et al. | |
| 2006/0105617 | A1 | 5/2006 | Padro et al. | |
| 2011/0256748 | A1 | 10/2011 | Davison et al. | |
| 2012/0045922 | A1 | 2/2012 | Giefers et al. | |

FOREIGN PATENT DOCUMENTS

| | | |
|---|---|---|
| JP | S59-170977 | 11/1984 |
| JP | S61-179680 | 11/1986 |
| WO | WO 2008/102544 | 8/2008 |

* cited by examiner

LATCHING CONNECTOR ASSEMBLY

TECHNICAL FIELD

The present disclosure relates to electrical cable connector assemblies and, in particular, to latching electrical cable connector assemblies.

BACKGROUND

Electrical cable connectors are used in a variety of applications, including for interconnecting computer components. As an example, electrical cable connectors include Serial Advanced Technology Attachment (Serial ATA or SATA) connectors, which are used, for example, to connect computer peripherals such as hard disk drives and optical drives. SATA connectors typically include socket connectors and plug connectors, which may be of the board mount connector type (e.g., for assembly to a printed circuit board) or of the cable connector type (e.g., for assembly to an electrical cable).

Although a latch for a SATA socket connector exists, when the SATA socket connector is of the board mount connector type (and the corresponding plug connector is of the cable connector type), in many applications, this latch cannot be reached, for example, to disengage the connectors. In this case, the connectors are typically engaged without locking or securing them together.

Although a SATA socket board mount connector may include a protrusion in a mating slot of the connector, and a corresponding SATA plug cable connector may include a recess that cooperates with this protrusion to provide some retention of the connectors in a mated configuration, this retention is typically not sufficient in a high vibration environment, such as, for example, in automotive applications.

SUMMARY

In at least one aspect, the present invention provides an electrical cable connector including a cable connector housing and a latch integrally attached to the cable connector housing. The cable connector housing includes a first set of electrical contacts. The latch includes a hinge portion, an arm portion, and an actuation portion. The hinge portion extends generally upwardly from the cable connector housing and attaches the latch to the housing. The arm portion extends generally forwardly from the hinge portion and includes a catch portion extending generally downwardly from a front end of the arm portion. The arm portion is able to pivot about the hinge portion and is adapted to securely attach the cable connector to a mating connector by engaging the catch portion to a back side of the mating connector. The actuation portion extends generally rearwardly from the hinge portion. Pressing down the actuation portion raises the catch portion.

In at least one aspect, the present invention provides a latching electrical cable connector assembly including a cable connector housing, a latch integrally attached to the cable connector housing, and a board mount connector housing. The cable connector housing includes a first set of electrical contacts. The latch includes a hinge portion, an arm portion, and an actuation portion. The hinge portion extends generally upwardly from the cable connector housing and attaches the latch to the housing. The arm portion extends generally forwardly from the hinge portion and includes a catch portion extending generally downwardly from a front end of the arm portion. The arm portion is able to pivot about the hinge portion. The actuation portion extends generally rearwardly from the hinge portion. Pressing down the actuation portion raises the catch portion. The board mount connector housing includes a second set of electrical contacts and a back side. The arm portion of the latch is adapted to securely attach the cable connector housing to the board mount connector housing by engaging the catch portion to a back side of the board mount connector housing such that the second set of electrical contacts is electrically connected to the first set of electrical contacts.

In at least one aspect, the present invention provides an electrical cable connector including a cable connector housing and a latch attached to the cable connector housing. The cable connector housing includes a first set of electrical contacts and a latch channel. The latch includes an arm portion, a hinge portion, and an actuation portion. The arm portion is disposed in the latch channel and includes a pair of latch arms. The latch arms include opposing catch portions disposed at a front end thereof and are adapted to securely attach the cable connector to a mating connector by surrounding a protrusion inside a housing of the mating connector. The hinge portion extends from a back end of the arm portion. The actuation portion extends generally upwardly from the hinge portion. Pressing down the actuation portion about the hinge portion splays the latch arms such that the catch portions are moved away from each other.

In at least one aspect, the present invention provides a latching electrical cable connector assembly including a cable connector housing, a latch attached to the cable connector housing, and a board mount connector housing. The cable connector housing includes a first set of electrical contacts and a latch channel. The latch includes an arm portion, a hinge portion, and an actuation portion. The arm portion is disposed in the latch channel and includes a pair of latch arms. The latch arms include opposing catch portions disposed at a front end thereof. The hinge portion extends from a back end of the arm portion. The actuation portion extends generally upwardly from the hinge portion. Pressing down the actuation portion about the hinge portion splays the latch arms such that the catch portions are moved away from each other. The board mount connector housing includes a second set of electrical contacts and a protrusion. The latch arms are adapted to securely attached the cable connector housing to the board mount connector housing by surrounding the protrusion such that the second set of electrical contacts is electrically connected to the first set of electrical contacts.

The above summary of the present invention is not intended to describe each disclosed embodiment or every implementation of the present invention. The Figures and detailed description that follow below more particularly exemplify illustrative embodiments.

DETAILED DESCRIPTION

In the following detailed description of the preferred embodiments, reference is made to the accompanying drawings that form a part hereof. The accompanying drawings show, by way of illustration, specific embodiments in which the invention may be practiced. It is to be understood that other embodiments may be utilized, and structural or logical changes may be made without departing from the scope of the present invention. The following detailed description, therefore, is not to be taken in a limiting sense, and the scope of the invention is defined by the appended claims.

In the illustrated embodiments, directional representations, i.e., up, down, left, right, front, rear and the like, used for explaining the structure and movement of the various elements of the present application, are relative. These representations are appropriate when the elements are in the position shown in the Figures. If the description of the position of the elements changes, however, it is assumed that these representations are to be changed accordingly.

Embodiments of electrical cable connectors according to aspects of the present invention provide an easy and reliable way of connecting to a mating connector. The electrical cable connector may include a latch that provides a fast way to engage and disengage the electrical cable connector from the mating connector, while providing a secure connection that can withstand high vibration environments such as ones that may exist in automotive and industrial applications, for example. In addition, the latch may be easily configured to work with different types of mating connectors, such as, e.g., Serial Advanced Technology Attachment (Serial ATA or SATA) or Serial Attached SCSI (SAS) socket board mount connectors and other types of socket board mount connectors, and may be included in different types of electrical cable connectors, such as, e.g., SATA or SAS plug cable connectors and other types of plug cable connectors.

Figure 1:
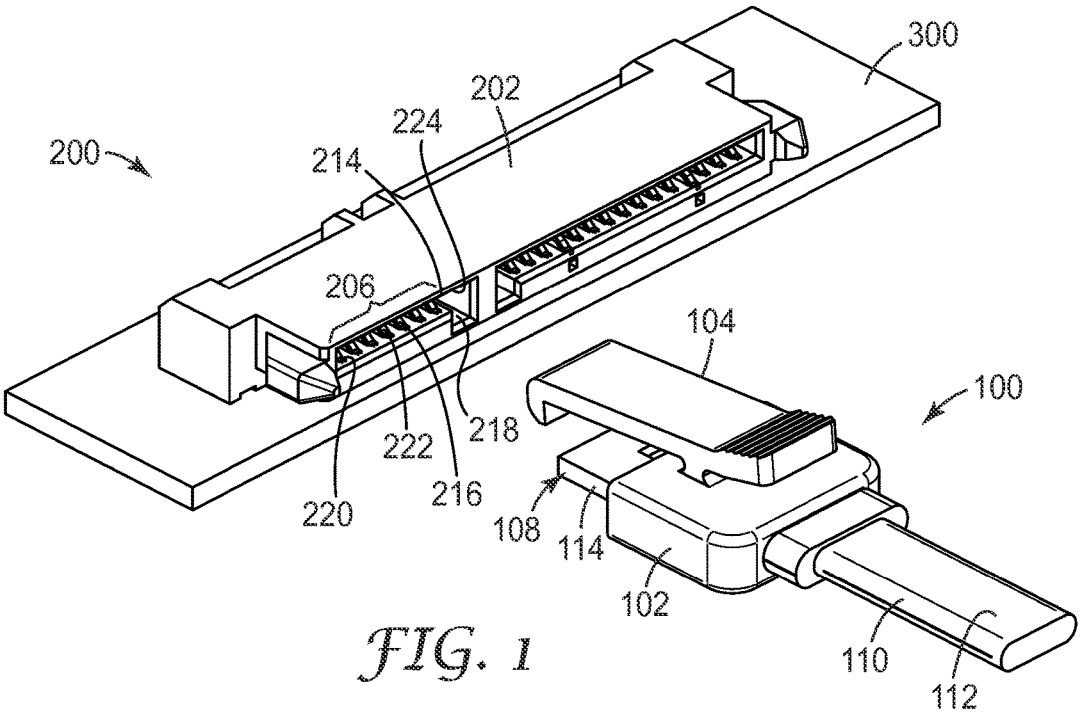
FIG. 1 is a perspective view of an exemplary embodiment of a cable connector and corresponding board mount connector according to an aspect of the present invention positioned for mating.
Figure 2:
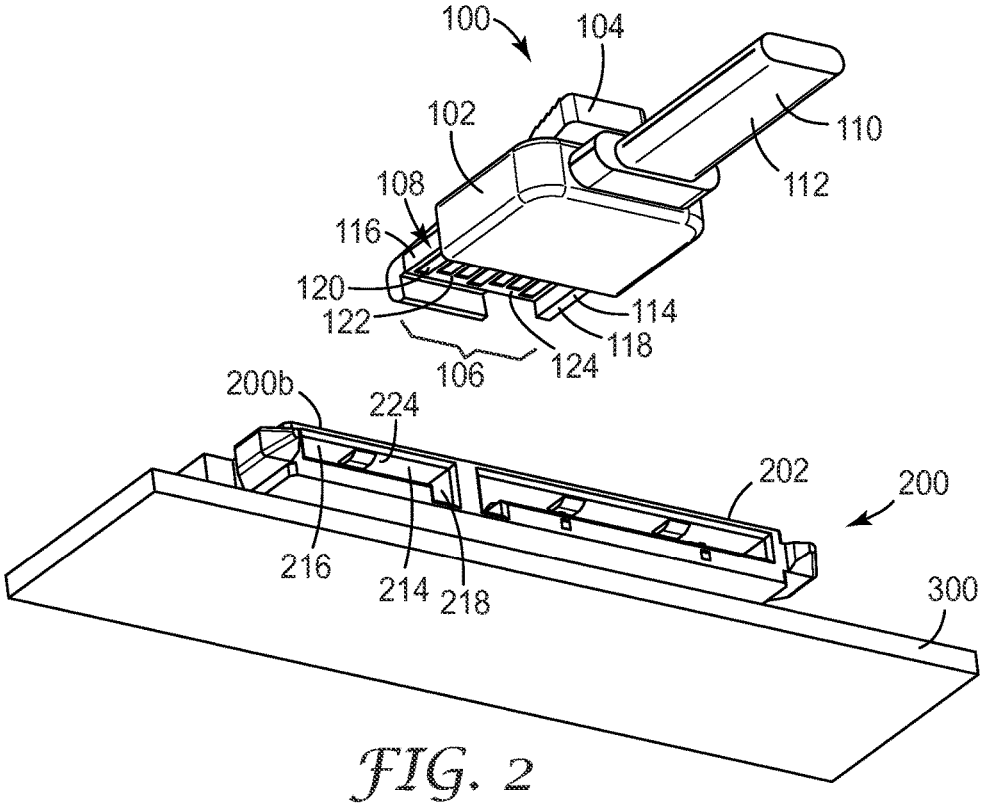
FIG. 2 is another perspective view of the cable connector and corresponding board mount connector of FIG. 1 positioned for mating.
Figure 3:
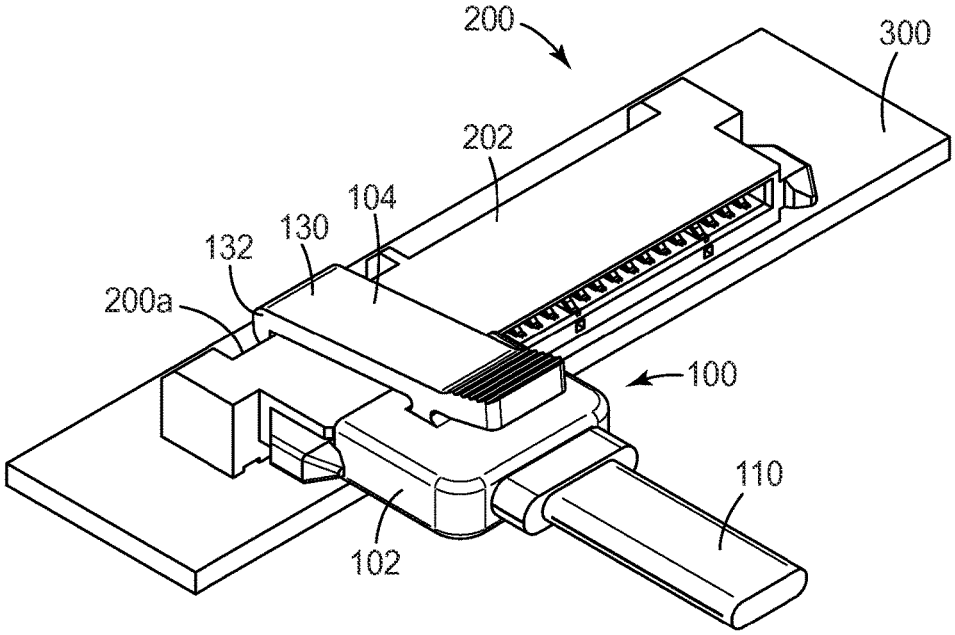
FIG. 3 is a perspective view of the cable connector and corresponding board mount connector of FIG. 1 in a mated configuration.
Figure 4:
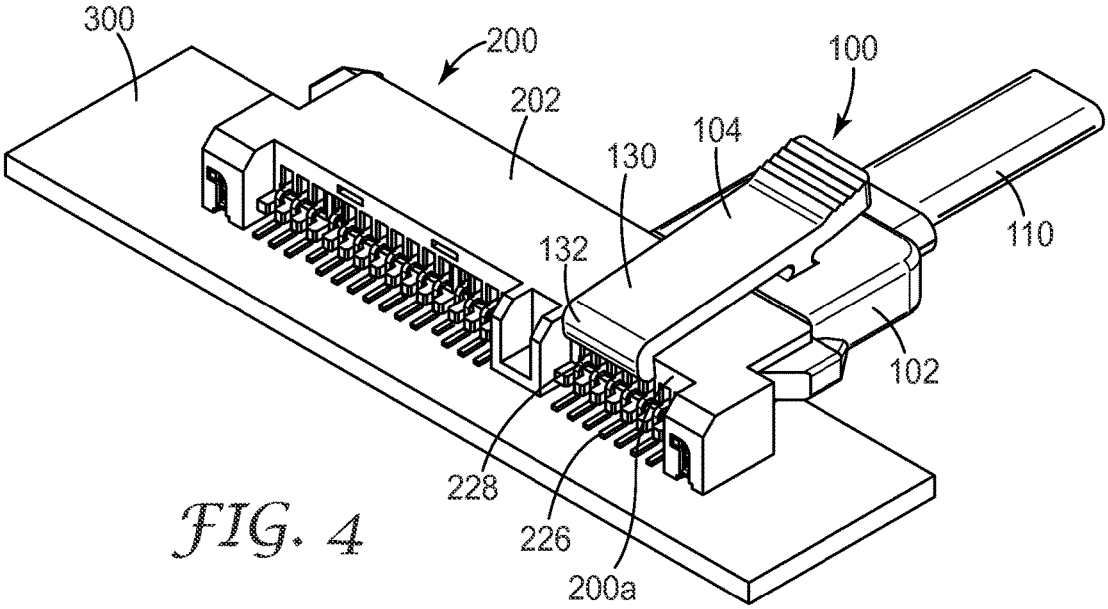
FIG. 4 is another perspective view of the cable connector and corresponding board mount connector of FIG. 1 in a mated configuration.

Referring now to the Figures, FIGS. 1-4 illustrate an exemplary embodiment of a cable connector and corresponding board mount connector according to an aspect of the present invention positioned for mating (FIGS. 1-2) and in a mated configuration (FIGS. 3-4). Electrical cable connector 100 includes a cable connector housing 102 including a first set of electrical contacts 106 (FIG. 2), assembled in a plug portion 108 with tail portions (not shown) exposed beyond plug portion 108. An electrical cable 110 is electrically connected with electrical contacts 106. Cable connector housing 102 is over-molded with a rear portion of plug portion 108 and a front end of electrical cable 110. A pair of projections (not shown) is formed on the rear portion of plug portion 108 for providing a retaining force between plug portion 108 and cable connector housing 102. Electrical cable 110 includes a plurality of conductive wires (not shown) electrically connecting with electrical contacts 106, and an outer insulating jacket 112 enclosing conductive wires therein. Cable connector housing 102 forms a strain relief between plug portion 108 and electrical cable 110. Cable connector housing 102 also protects the electrical connections between electrical contacts 106 and the conductive wires of electrical cable 110. Plug portion 108 includes an L-shaped tongue 114 (FIG. 2) protruding therefrom. L-shaped tongue 114 includes a main portion 116 and a side portion 118 perpendicular with main portion 116. Plug portion 108 includes a plurality of receiving passageways 122 receiving electrical contacts 106. Each electrical contact 106 includes a contacting portion 120 received in a corresponding receiving passageway 122 and exposing to a face 124 of main portion 116 for electrically connecting with a mating electrical contact, a retaining portion (not shown) fixed to the receiving passageway, and a terminal portion (not shown) for electrically connecting with a corresponding conductive wire of electrical cable 110.

In at least one embodiment, electrical cable connector 100 is a plug connector in accordance with the Small Form Factor (SFF) industry standard SFF-8482. In at least one embodiment, electrical cable connector 100 is a SATA plug connector, for example in accordance with the Serial ATA Revision 3.0 Specification, wherein seven electrical contacts 106 are received in plug portion 108 and constituted of three ground contacts and four differential signal contacts, for example as shown in FIG. 2. This connector may be referred to as a 7P SATA plug connector.

Board mount connector 200 is configured for mating to electrical cable connector 100 and includes a connector housing 202 including a second set of electrical contacts 206. Connector housing 202 defines a first L-shaped opening 214 and a first plurality of passageways 222. First L-shaped opening 214 defines a main opening 216 and a side opening 218 perpendicular with main opening 216. Passageways 222 are arranged in a lengthwise direction perpendicular with the up-to-down direction and communicate with first L-shaped opening 214. Electrical contacts 206 are received in passageways 222. Each electrical contact 206 includes a contacting portion 220 exposing to a face 224 of main opening 216, a terminal portion 226 (FIG. 4), and a retaining portion 228 (FIG. 4) bridging contacting portion 220 and terminal portion 226. Retaining portions 228 are secured to passageways 222 by barbs at the opposite ends thereof. Terminal portions 226 extend out of connector housing 202 for attachment to a printed circuit board 300. When electrical cable connector 100 is inserted into board mount connector 200, first L-shaped opening 214 receives L-shaped tongue 114, and contacting portions 120 of electrical contacts 106 contact with contacting portions 220 of electrical contacts 206.

Figure 5:
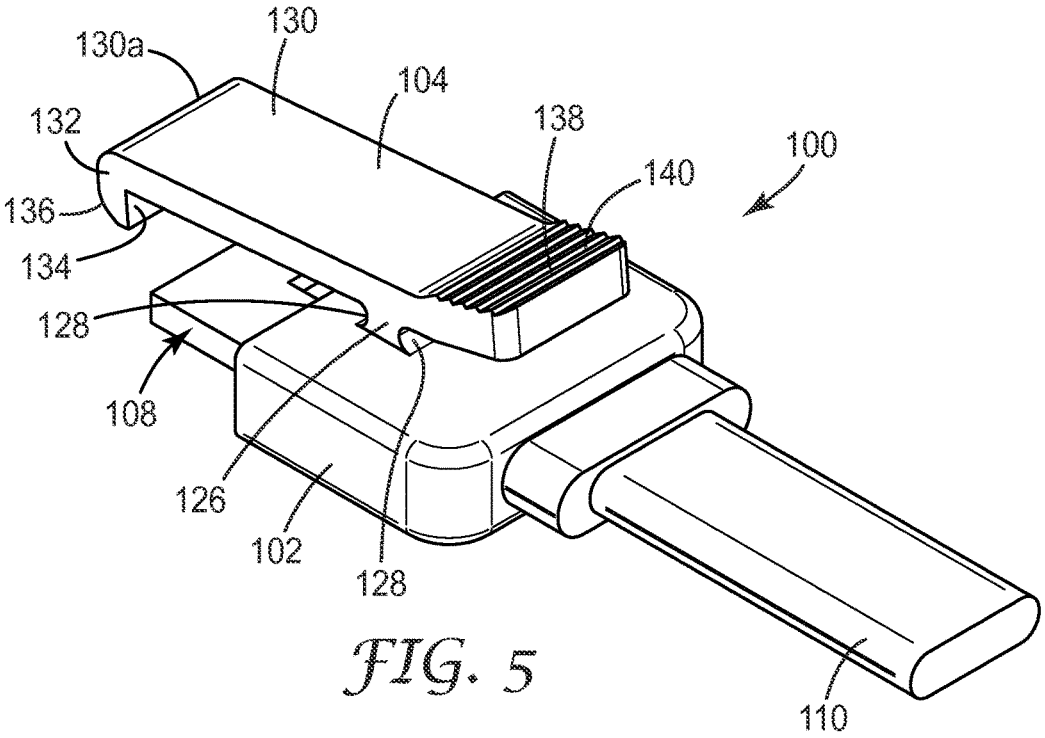
FIG. 5 is a perspective view of the cable connector of FIG. 1.
Figure 6:
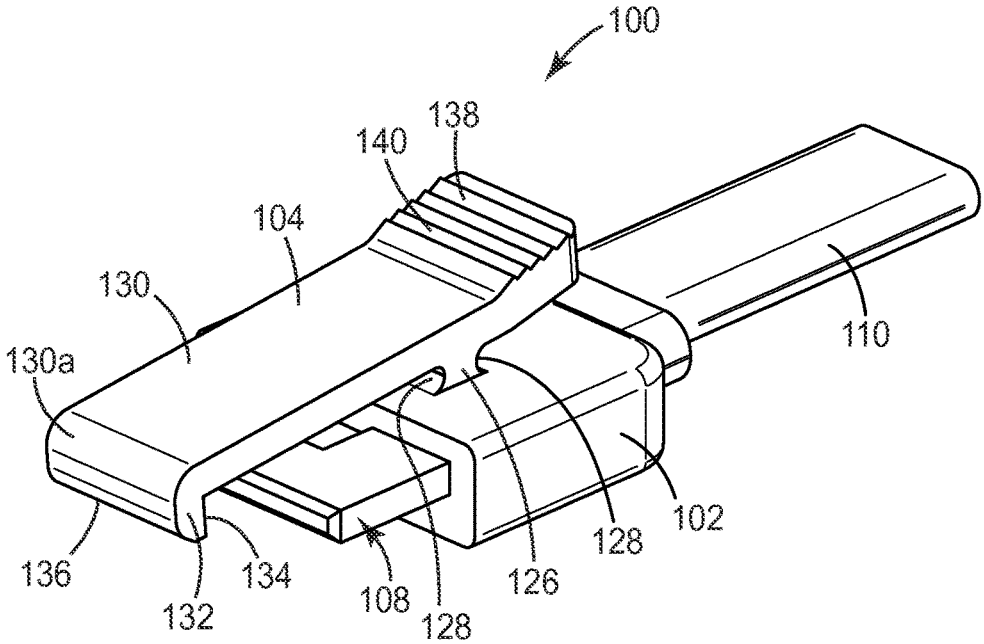
FIG. 6 is another perspective view of the cable connector of FIG. 1.

According to one aspect of the present invention, electrical cable connector 100 includes a latch 104 integrally attached to cable connector housing 102. Latch 104 provides an easy and reliable way of connecting electrical cable connector 100 to board mount connector 200. Referring to FIGS. 5-6, latch 104 includes a hinge portion 126 extending generally upwardly from cable connector housing 102. Hinge portion 126 attaches latch 104 to cable connector housing 102. Hinge portion 126 facilitates a pivoting motion of latch 104 with respect to cable connector housing 102. In at least one embodiment, to accommodate a pivoting motion, hinge portion 126 is resilient. The resilience of hinge portion 126 allows latch 104 to depart from and return to its initial position during actuation. In at least one embodiment, to accommodate a pivoting motion, hinge portion 126 has curved front and rear surfaces 128. Curved front and rear surfaces 128 provide a gradual transition between latch 104 and cable connector housing 102. In at least one embodiment, curved front and rear surfaces 128 are tangential to at least one of a surface of latch 104 and a surface of cable connector housing 102. In at least one embodiment, curved front and rear surfaces 128 have a radius in the range from about 0.50 mm to about 0.75 mm. Preferably, hinge portion 126 is configured to accommodate a number of actuations corresponding with the number of mating cycles (i.e., insertions and removals) electrical cable connector 100 is configured to perform. For example, in at least one embodiment, hinge portion 126 is configured to accommodate at least 100 actuations. Both the resilience and the curved front and rear surfaces of hinge portion 126 help to achieve this.

Latch 104 further includes an arm portion 130 extending generally forwardly from hinge portion 126. Arm portion 130 includes a catch portion 132 extending generally downwardly from a front end 130*a* of arm portion 130. Arm portion 130 is able to pivot about hinge portion 126. Arm portion 130 is adapted to securely attach electrical cable connector 100 to a mating connector by engaging catch portion 132 to a back side of the mating connector. An example of this attachment is shown in FIGS. 3-4, where arm portion 130 securely attaches electrical cable connector 100 to board mount connector 200 by engaging catch portion 132 to a back side 200*a* of board mount connector 200. In at least one embodiment, catch portion 132 is generally perpendicular to arm portion 130. More particularly, catch portion 132 extends from arm portion 130 such as to define an engagement surface 134 extending generally perpendicularly from arm portion 130. The spacing between cable connector housing 102 and latch 104 at hinge portion 126 results in a slightly angled orientation of engagement surface 134 with respect to back side 200*a* of board mount connector 200. This slightly angled orientation contributes to a secure connection between electrical cable connector 100 and board mount connector 200 that can withstand high vibration environments such as ones that may exist in automotive and industrial applications, for example. In at least one embodiment, catch portion 132 includes a rounded or chamfered front edge 136 to accommodate engagement of electrical cable connector 100 to a mating connector. For example, during engagement of electrical cable connector 100 to board mount connector 200, front edge 136 engages a front side 200*b* (FIG. 2) of board mount connector 200, lifting front end 130*a* of arm portion 130 (pivoting latch 104 about hinge portion 126) to allow further engagement of electrical cable connector 100. A lifted front end 130*a* of arm portion 130 places latch 104 under spring tension during further engagement of electrical cable connector 100. This spring tension facilitates engagement of catch portion 132 to back side 200*a* of board mount connector 200 when electrical cable connector 100 is fully engaged to board mount connector 200. In at least one embodiment, arm portion 130 has a length selected such that when electrical cable connector 100 is fully engaged to a mating connector, catch portion 132 engages a back side of the mating connector. An example of this is shown in FIGS. 3-4.

Latch 104 further includes an actuation portion 138 extending generally rearwardly from hinge portion 126. Pressing down actuation portion 138 pivots latch 104 about hinge portion 126, and raises catch portion 132. In one aspect, actuation portion 138 may be pressed down to disengage catch portion from back side 200*a* of board mount connector 200 when electrical cable connector 100 is fully engaged to board mount connector 200, which allows electrical cable connector 100 to be disengaged from board mount connector 200. In one aspect, actuation portion 138 may be pressed down during engagement of electrical cable connector 100 to board mount connector 200 to raise catch portion 132, in which case front edge 136 of catch portion 132 would not engage front side 200*b* of board mount connector 200. Advantageously, actuation portion 138 allows latch 104 to be single-handedly operated. For example, actuation portion 138 may be pressed down by a thumb while cable connector housing 102 is supported by an index finger, or vice versa. In at least one embodiment, actuation portion 138 slopes away from cable connector housing 102 as it extends from hinge portion 126. The slope in actuation portion 138 with respect to cable connector housing 102 allows actuation portion 138 to be pressed down further than an actuation portion 138 that is substantially parallel to cable connector housing 102 as it extends from hinge portion 126. When actuation portion 138 can be pressed down further, catch portion 132 can be raised further, which facilitates the engagement and disengagement of catch portion 132 and easy operation of latch 104. In at least one embodiment, actuation portion 138 slopes away from cable connector housing 102 as it extends from hinge portion 126 at an angle of about 11 degrees. In at least one embodiment, actuation portion 138 slopes away from cable connector housing 102 as it extends from hinge portion 126 such that when actuation portion 138 is fully pressed down (i.e., touches cable connector housing 102), it is substantially parallel to cable connector housing 102. In at least one embodiment, actuation portion includes a plurality of protrusions 140 defining a gripping surface for latch 104. In the embodiment illustrated in FIGS. 5-6, protrusions 140 include a plurality of evenly spaced lateral ridges. In other embodiments, protrusions 140 may include any other suitable structures and configurations, such as, e.g., an embossed circular shape. Alternatively, a gripping surface may be defined by any suitable surface modification of actuation portion 138. The gripping surface facilitates the actuation of latch 104. It provides a non-slip surface to actuation portion 138, which facilitates a safe and effective actuation of latch 104. It also allows for a user to locate actuation portion 138 solely based on touch, which facilitates latch 104 to be operated in visually obstructed locations.

In at least one embodiment, hinge portion 126, arm portion 130, catch portion 132, and actuation portion 138 have substantially the same width, which provides a simple and cost-effective design of latch 104. In other embodiments, hinge portion 126, arm portion 130, catch portion 132, and actuation portion 138 may have different widths as suitable for the intended application. In at least one embodiment, arm portion 130 has a tapered configuration, wherein its width decreases as it extends from hinge portion 126. In this embodiment, catch portion 132 has a smaller width than hinge portion 126 and actuation portion 138.

In at least one embodiment, latch 104 is located substantially in the center of cable connector housing 102, for example as shown in FIGS. 5-6. In other embodiments, latch 104 may be integrally attached to cable connector housing 102 in any suitable location.

Figure 7:
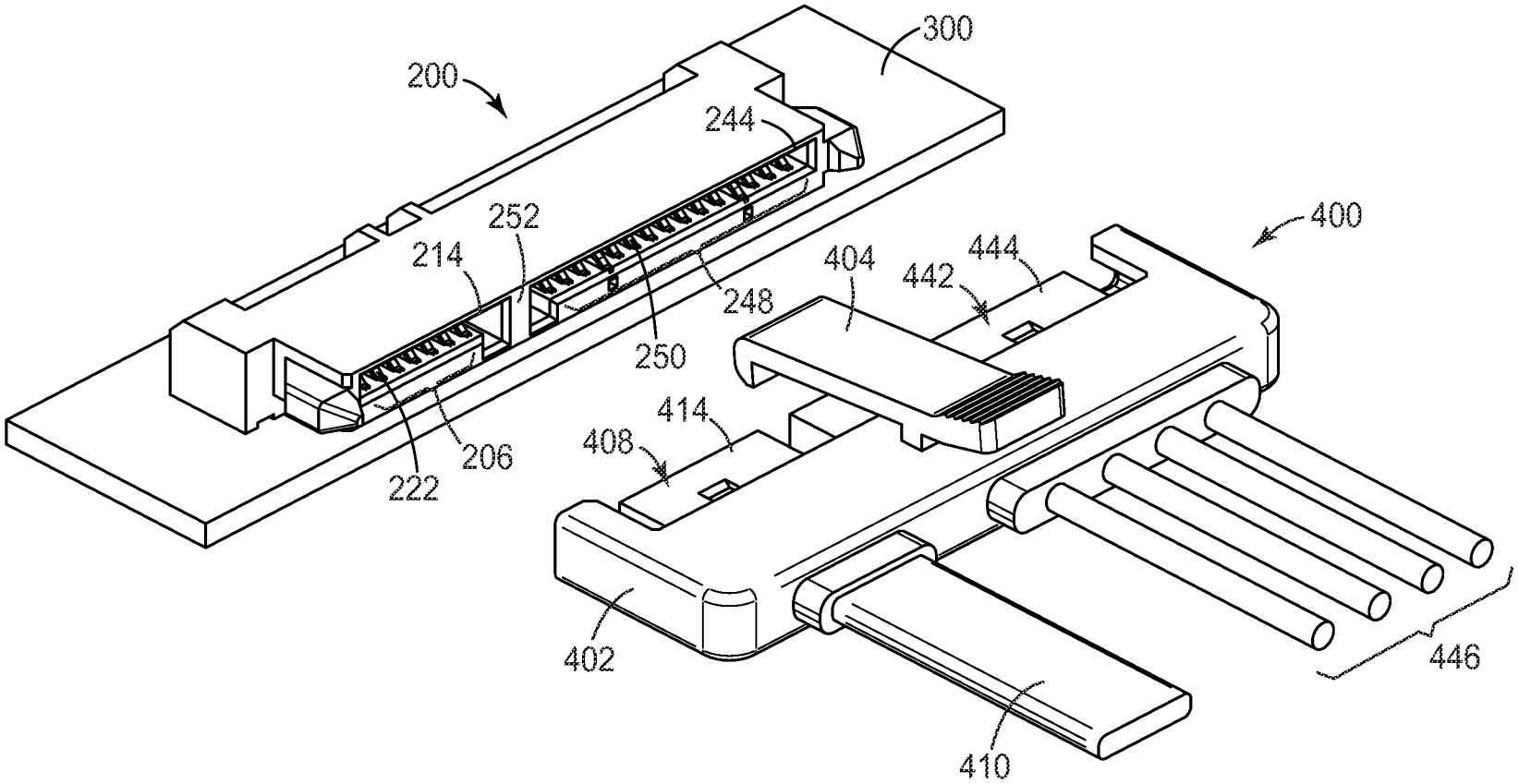
FIG. 7 is a perspective view of another exemplary embodiment of a cable connector and corresponding board mount connector according to an aspect of the present invention positioned for mating.
Figure 8:
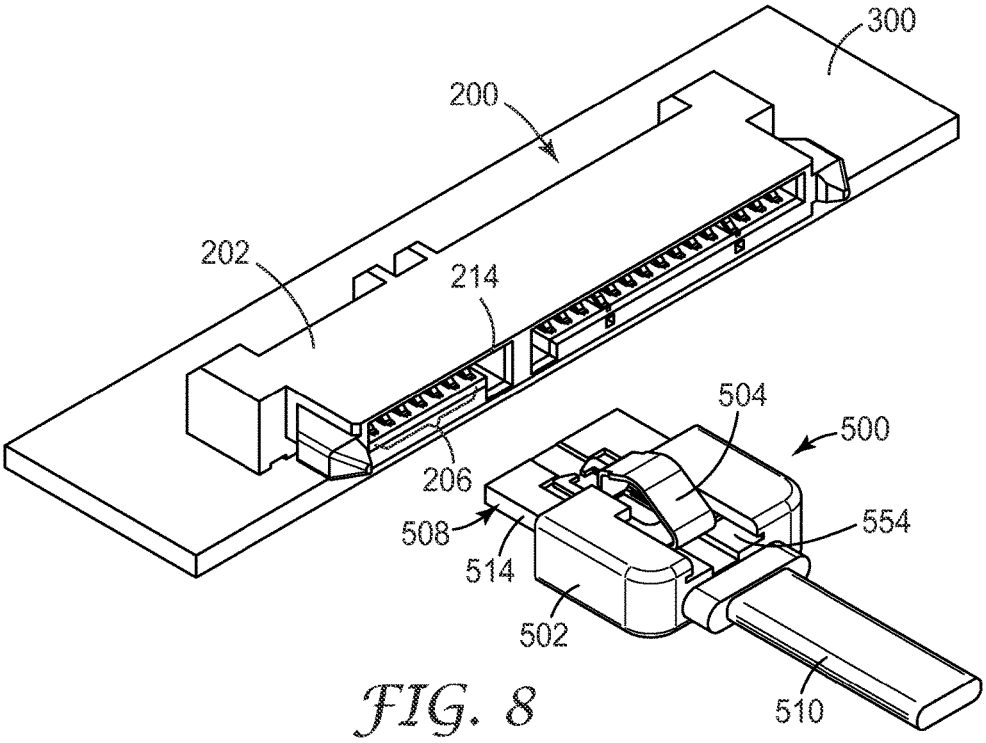
FIG. 8 is a perspective view of another exemplary embodiment of a cable connector and corresponding board mount connector according to an aspect of the present invention positioned for mating.

Referring now to FIG. 7, FIG. 7 illustrates another exemplary embodiment of a cable connector and corresponding board mount connector according to an aspect of the present invention positioned for mating. Electrical cable connector 400 includes a cable connector housing 402 including a first set of electrical contacts (not shown), assembled in a first plug portion 408. First plug portion 408 includes a first L-shaped tongue 414 protruding therefrom. An electrical cable 410 is electrically connected with the first set of electrical contacts. First set of electrical contacts, first plug portion 408, and electrical cable 410 are similar to corresponding elements of electrical cable connector 100. Cable connector housing 402 further includes a third set of electrical contacts (not shown), assembled in a second plug portion 442. Second plug portion 442 includes a second L-shaped tongue 444 protruding therefrom. A set of electrical cables 446 is electrically connected with the third set of electrical contacts. Third set of electrical contacts, second plug portion 442, and electrical cables 446 are similar to corresponding elements of electrical cable connector 100, although in at least one embodiment, for example as shown in FIG. 7, the number of electrical contacts in the third set of electrical contacts is different, the width and orientation of second plug portion 442 is different, and the number and configuration of electrical cables 446 is different.

In at least one embodiment, electrical cable connector 400 is a plug connector in accordance with SFF-8482. In at least one embodiment, electrical cable connector 400 is a SATA plug connector, for example in accordance with the Serial ATA Revision 3.0 Specification, wherein seven electrical contacts are received in first plug portion 408 and constituted of three ground contacts and four differential signal contacts, and fifteen electrical contacts are received in second plug portion 442 and constituted of fifteen power contacts, for example as shown in FIG. 7. This connector may be referred to as a 22P SATA plug connector.

Board mount connector 200 is configured for mating to electrical cable connector 400. Continuing the description of board mount connector 200, board mount connector 200 further includes a fourth set of electrical contacts 248 received in connector housing 202. Connector housing 202 defines a second L-shaped opening 244 and a second plurality of passageways 250. Second L-shaped opening 244 is separated from first L-shaped opening 214 by a partition wall 252. Electrical contacts 248 are received in passageways 250. Fourth set of electrical contacts 248, second L-shaped opening 244, and passageways 250 are similar to second set of electrical contacts 206, first L-shaped opening 214, and passageways 222, respectively, although in at least one embodiment, for example as shown in FIG. 7, the number of electrical contacts in the fourth set of electrical contacts is different, the width and orientation of second L-shaped opening 244 is different, and the number of passageways 250 is different. When electrical cable connector 400 is inserted into board mount connector 200, first L-shaped opening 214 receives first L-shaped tongue 414, second L-shaped opening 244 receives second L-shaped tongue 444, first set of electrical contacts contact with second set of electrical contacts 206, and third set of electrical contacts contact with fourth set of electrical contacts 248.

In at least one embodiment, board mount connector 200 is a socket connector in accordance with SFF-8482. In at least one embodiment, board mount connector 200 is a SATA socket connector, for example in accordance with the Serial ATA Revision 3.0 Specification, wherein seven electrical contacts are received in passageways 222 and constituted of three ground contacts and four differential signal contacts, and fifteen electrical contacts are received in passageways 250 and constituted of fifteen power contacts, for example as shown in FIG. 7. This connector may be referred to as a 22P SATA socket connector. In at least one embodiment, board mount connector 200 is a right angle connector, wherein the mating direction of the board mount connector is substantially parallel to the printed circuit board to which the board mount connector is attached, for example as shown in FIG. 7. In at least one embodiment, board mount connector 200 is a vertical or straight connector, wherein the mating direction of the board mount connector is substantially perpendicular to the printed circuit board to which the board mount connector is attached. In case board mount connector 200 is a vertical or straight connector, it may be configured to include a space between back side 200*a* and printed circuit board 300 to accommodate catch portion 132 of latch 104.

According to one aspect of the present invention, electrical cable connector 400 includes a latch 404 integrally attached to cable connector housing 402. Latch 404 provides an easy and reliable way of connecting electrical cable connector 400 to board mount connector 200. Latch 404 is similar to latch 104 as described above with respect to electrical cable connector 100. In at least one embodiment, latch 404 is located substantially in the center of cable connector housing 402, for example as shown in FIG. 7. In other embodiments, latch 404 may be integrally attached to cable connector housing 402 in any suitable location.

Figure 9:
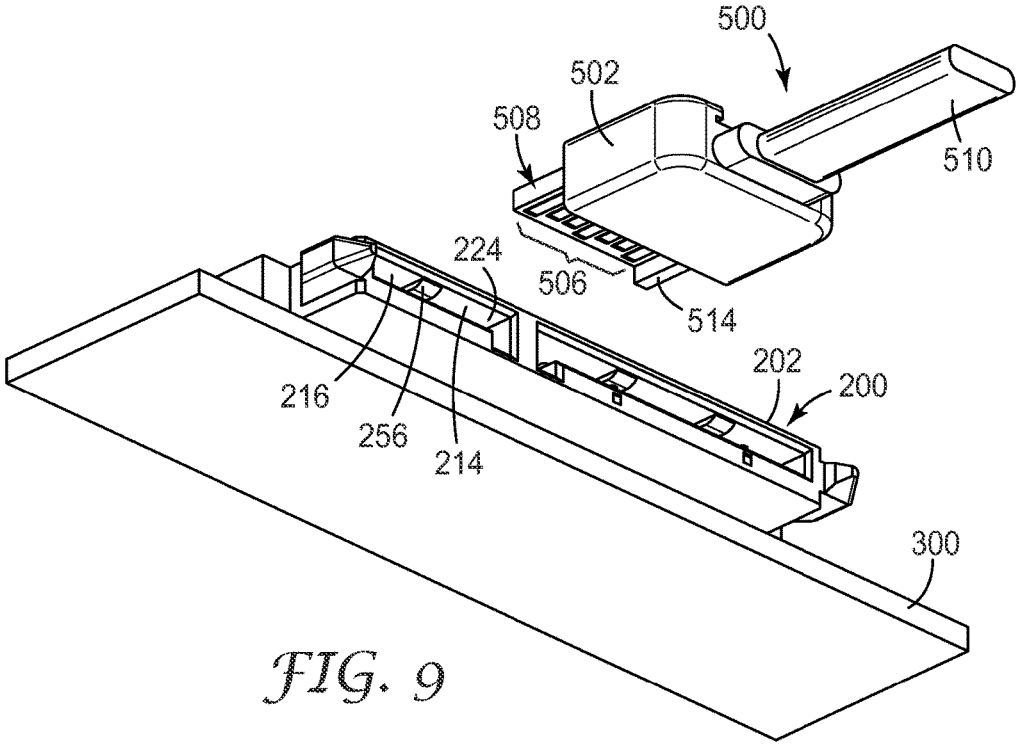
FIG. 9 is another perspective view of the cable connector and corresponding board mount connector of FIG. 8 positioned for mating.
Figure 10:
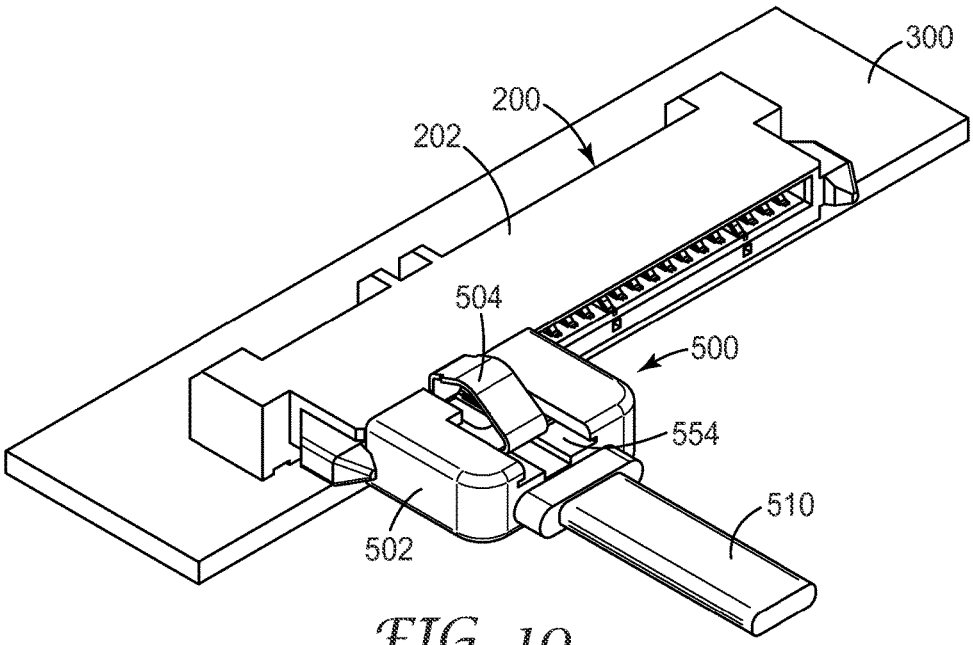
FIG. 10 is a perspective view of the cable connector and corresponding board mount connector of FIG. 8 in a mated configuration.
Figure 11:
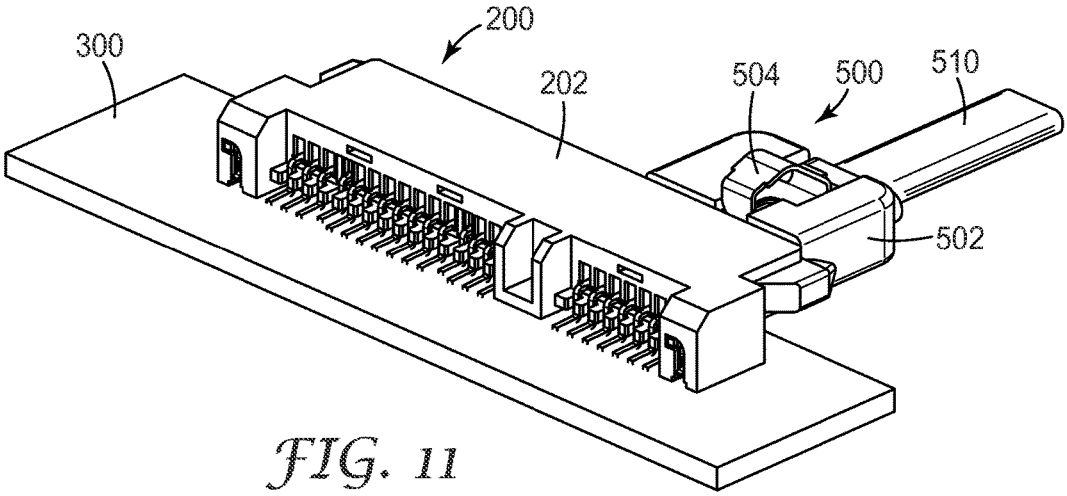
FIG. 11 is another perspective view of the cable connector and corresponding board mount connector of FIG. 8 in a mated configuration.

FIGS. 8-11 illustrate another exemplary embodiment of a cable connector and corresponding board mount connector according to an aspect of the present invention positioned for mating (FIGS. 8-9) and in a mated configuration (FIGS. 10-11). Electrical cable connector 500 includes a cable connector housing 502 including a first set of electrical contacts 506 (FIG. 9), assembled in a plug portion 508. Plug portion 508 includes an L-shaped tongue 514 protruding therefrom. An electrical cable 510 is electrically connected with electrical contacts 506. First set of electrical contacts 506, plug portion 508, and electrical cable 510 are similar to corresponding elements of electrical cable connector 100.

In at least one embodiment, electrical cable connector 500 is a plug connector in accordance with SFF-8482. In at least one embodiment, electrical cable connector 500 is a SATA plug connector, for example in accordance with the Serial ATA Revision 3.0 Specification, wherein seven electrical contacts 506 are received in plug portion 508 and constituted of three ground contacts and four differential signal contacts, for example as shown in FIG. 9. This connector may be referred to as a 7P SATA plug connector.

Cable connector housing 502 is similar to cable connector housing 102 of electrical cable connector 100, although in at least one embodiment, for example as shown in FIGS. 8-11, cable connector housing 502 includes a latch channel 554 configured to receive a latch.

Board mount connector 200 is configured for mating to electrical cable connector 500. Continuing the description of board mount connector 200, board mount connector 200 further includes a protrusion 256 (FIG. 9) inside connector housing 202. In at least one embodiment, protrusion 256 is defined by SFF-8482, and is disposed on face 224 of main opening 216.

When electrical cable connector 500 is inserted into board mount connector 200, first L-shaped opening 214 receives L-shaped tongue 514, and electrical contacts 506 contact with electrical contacts 206.

Figure 12:
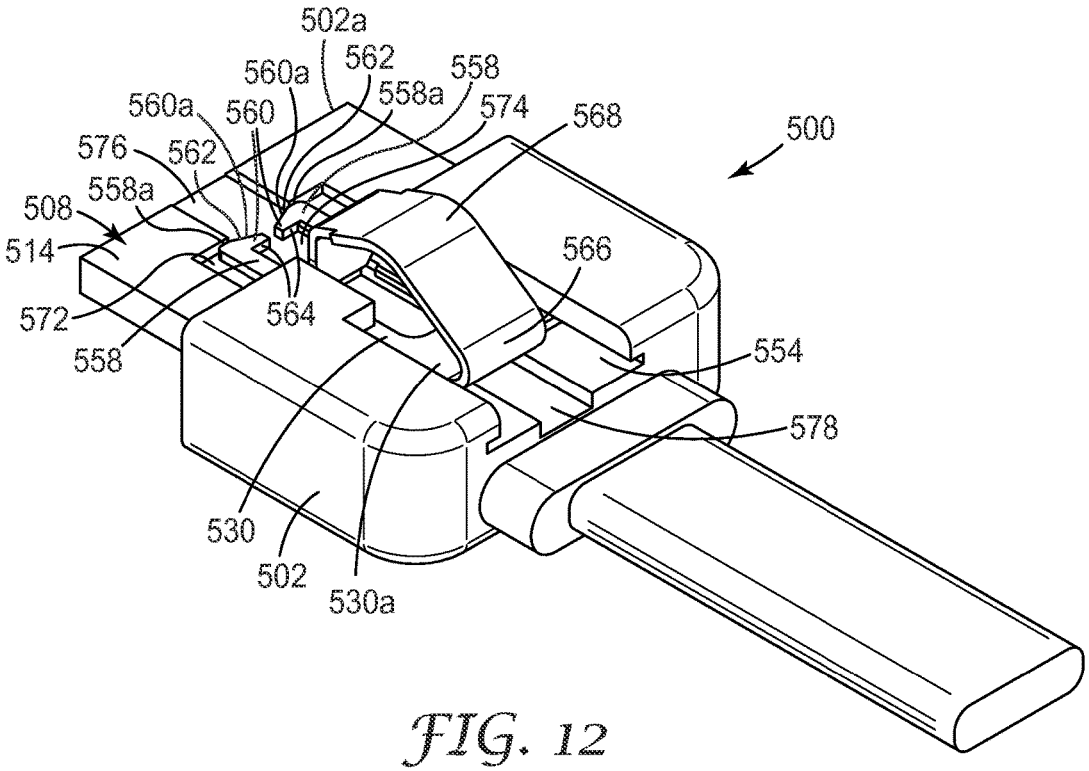
FIG. 12 is a perspective view of the cable connector of FIG. 8.
Figure 13:
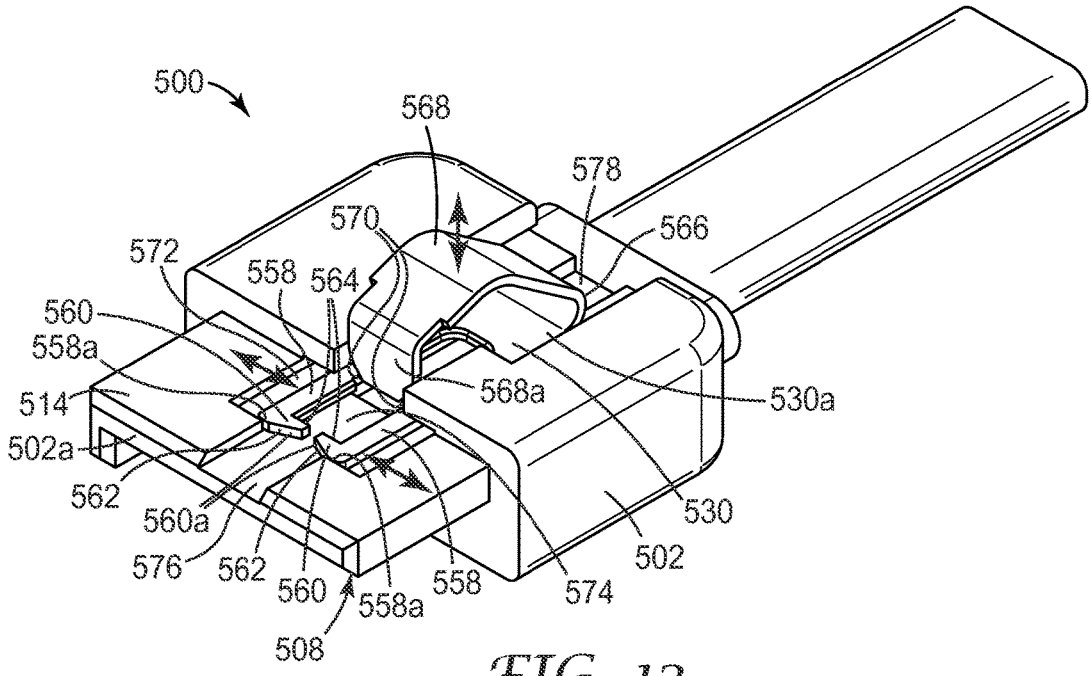
FIG. 13 is another perspective view of the cable connector of FIG. 8.

According to one aspect of the present invention, electrical cable connector 500 includes a latch 504 attached to cable connector housing 502. Latch 504 provides an easy and reliable way of connecting electrical cable connector 500 to board mount connector 200. Referring to FIGS. 12-13, latch 504 includes an arm portion 530 disposed in latch channel 554. Arm portion 530 attaches latch 504 to cable connector housing 502. In one aspect, arm portion 530 cooperates with latch channel 554 to retain latch 504 in a fixed relative position with respect to cable connector housing 502. Latch 504 may be retained by using any suitable method/structure, including but not limited to friction fit, press fit, mechanical clamping, and adhesive. For example to create a friction fit retention, the width and/or thickness of arm portion 530 may be slightly greater than the width and/or thickness of latch channel 554, respectively, in an area designated for retention. For example to create a press-fit retention, arm portion 530 may have one or more retention barbs (not shown) extending from opposing sides of arm portion 530 in an area designated for retention. Arm portion 530 includes a pair of latch arms 558. Latch arms 558 extend generally in the mating direction of electrical cable connector 500 and are generally in the same plane as arm portion 530. Latch arms 558 include opposing catch portions 560 disposed at a front end 558*a* of latch arms 558. Catch portions 560 are adapted to securely attach electrical cable connector 500 to a mating connector by surrounding a protrusion inside a housing of the mating connector. For example, in at least one embodiment, catch portions 560 are adapted to securely attach cable connector 500 to board mount connector 200 by surrounding protrusion 256 (FIG. 9). In at least one embodiment, catch portions 560 are generally perpendicular to latch arms 558. More particularly, catch portions 560 extend from latch arms 558 such as to define engagement surfaces 564 extending generally perpendicularly from latch arms 558. This general perpendicular orientation of engagement surfaces 564 contributes to a secure connection between electrical cable connector 500 and board mount connector 200 that can withstand high vibration environments such as ones that may exist in automotive and industrial applications, for example. In at least one embodiment, opposing catch portions 560 include ramp surfaces 562 disposed at a front end 560*a* of catch portions 560 to accommodate engagement of electrical cable connector 500 to a mating connector. For example, during engagement of electrical cable connector 500 to board mount connector 200, ramp surfaces 562 engage protrusion 256 of board mount connector 200, splaying latch arms 558 while receiving protrusion 256 to allow further engagement of electrical cable connector 500. Splayed latch arms 558 are under spring tension during further engagement of electrical cable connector 500. This spring tension facilitates engagement of catch portions 560 around protrusion 256 of board mount connector 200 when electrical cable connector 500 is fully engaged to board mount connector 200. In at least one embodiment, to accommodate the splaying of latch arms 558, latch arms 558 are resilient. The resilience allows latch arms 558 to depart from and return to their initial position during actuation. In at least one embodiment, to accommodate the splaying of latch arms 558, arm portion 530 is generally U-shaped. Preferably, latch arms 558 are configured to accommodate a number of actuations corresponding with the number of mating cycles (i.e., insertions and removals) electrical cable connector 500 is configured to perform. Both the resilience of latch arms 558 and the general U-shape of arm portion 530 help to achieve this.

Latch 504 further includes a hinge portion 566 extending from a back end 530*a* of arm portion 530, and an actuation portion 568 extending generally upwardly from hinge portion 566. Hinge portion 566 connects actuation portion 568 to arm portion 530. Hinge portion 566 facilitates a pivoting motion of actuation portion 568 with respect to arm portion 530 and cable connector housing 502. In at least one embodiment, to accommodate a pivoting motion, hinge portion 566 is resilient. The resilience of hinge portion 566 allows actuation portion 568 to depart from and return to its initial position during actuation. In at least one embodiment, to accommodate a pivoting motion, hinge portion 566 has a curved shape. The curved shape provides a gradual transition between arm portion 530 and actuation portion 568. Preferably, hinge portion 566 is configured to accommodate a number of actuations corresponding with the number of mating cycles (i.e., insertions and removals) electrical cable connector 500 is configured to perform. Both the resilience and the curved shape of hinge portion 566 help to achieve this. Pressing down actuation portion 568 about hinge portion 566 splays latch arms 558 such that catch portions 560 are moved away from each other. In one aspect, actuation portion 568 may be pressed down to disengage catch portions 560 from protrusion 256 of board mount connector 200 when electrical cable connector 500 is fully engaged to board mount connector 200, which allows electrical cable connector 500 to be disengaged from board mount connector 200. In one aspect, actuation portion 568 may be pressed down during engagement of electrical cable connector 500 to board mount connector 200 to move catch portions 560 away from each other, in which case ramp surfaces 562 of catch portions 560 would not engage protrusion 256 of board mount connector 200. This motion is illustrated by the arrows in FIG. 13. Advantageously, actuation portion 568 allows latch 504 to be single-handedly operated. For example, actuation portion 568 may be pressed down by a thumb while cable connector housing 502 is supported by an index finger, or vice versa. In at least one embodiment, actuation portion 568 includes ramp surfaces 570 (FIG. 13) disposed at a front end 568*a* thereof. Ramp surfaces 570 are configured to splay latch arms 558 while pressing down actuation portion 568.

In at least one embodiment, latch 504 is formed of metal by a metal stamping process, wherein arm portion 530, hinge portion 566, and actuation portion 568 are integrally stamped and formed from a sheet metal blank. In at least one embodiment, latch 504 is located with respect to L-shaped tongue 514 such as to correspond to the location of protrusion 256 with respect to first L-shaped opening 214 of board mount connector 200, resulting in a proper alignment of latch arms 558 and protrusion 256 during engagement of electrical cable connector 500 to board mount connector 200.

In one aspect, cable connector housing 502 may be configured to accommodate the operation of latch 504. For example, in at least one embodiment, latch channel 554 includes a first recess 572 disposed at a bottom thereof. Latch arms 558 are slidably positioned in first recess 572. First recess 572 has a width such as to accommodate splaying of latch arms 558. In at least one embodiment, first recess 572 includes a rear portion 574 and a front portion 576. Front portion 576 extends between rear portion 574 and a front surface 502*a* of cable connector housing 502. Latch arms 558 are slidably positioned in rear portion 574. Front portion 576 is configured to receive protrusion 256. In at least one embodiment, a width of front portion 576 is smaller than a width of rear portion 574, for example as shown in FIGS. 12-13. In at least one embodiment, latch channel 554 includes a second recess 578 disposed at a bottom thereof. Second recess 578 is configured to receive front end 568*a* of actuation portion 568 of latch 504 when actuation portion 568 is pressed down.

Following are exemplary embodiments of an electrical cable connector or a latching electrical cable connector assembly according to aspects of the present invention.

Embodiment 1 is an electrical cable connector comprising: a cable connector housing including a first set of electrical contacts; and a latch integrally attached to the cable connector housing, the latch including: a hinge portion extending generally upwardly from the cable connector housing and attaching the latch to the housing; an arm portion extending generally forwardly from the hinge portion and including a catch portion extending generally downwardly from a front end of the arm portion, the arm portion being able to pivot about the hinge portion and being adapted to securely attach the cable connector to a mating connector by engaging the catch portion to a back side of the mating connector; and an actuation portion extending generally rearwardly from the hinge portion, wherein pressing down the actuation portion raises the catch portion.

Embodiment 2 is the electrical cable connector of embodiment 1, wherein the hinge portion is resilient.

Embodiment 3 is the electrical cable connector of embodiment 1, wherein the hinge portion has curved front and rear surfaces.

Embodiment 4 is the electrical cable connector of embodiment 1, wherein the arm portion has a length selected such that when the cable connector is fully engaged to a mating connector, the catch portion engages the back side of the mating connector.

Embodiment 5 is the electrical cable connector of embodiment 1, wherein the catch portion is generally perpendicular to the arm portion.

Embodiment 6 is the electrical cable connector of embodiment 1, wherein the actuation portion slopes away from the cable connector housing as it extends from the hinge portion.

Embodiment 7 is the electrical cable connector of embodiment 1, wherein the actuation portion includes a plurality of protrusions defining a gripping surface for the latch.

Embodiment 8 is the electrical cable connector of embodiment 1, wherein the hinge portion, the arm portion, the catch portion, and the actuation portion have substantially the same width.

Embodiment 9 is a latching electrical cable connector assembly comprising: a cable connector housing including a first set of electrical contacts; a latch integrally attached to the cable connector housing, the latch including: a hinge portion extending generally upwardly from the cable connector housing and attaching the latch to the housing; an arm portion extending generally forwardly from the hinge portion and including a catch portion extending generally downwardly from a front end of the arm portion, the arm portion being able to pivot about the hinge portion; and an actuation portion extending generally rearwardly from the hinge portion, wherein pressing down the actuation portion raises the catch portion; and a board mount connector housing including a second set of electrical contacts and a back side, wherein the arm portion of the latch is adapted to securely attach the cable connector housing to the board mount connector housing by engaging the catch portion to a back side of the board mount connector housing such that the second set of electrical contacts is electrically connected to the first set of electrical contacts.

Embodiment 10 is the latching electrical cable connector assembly of embodiment 9, wherein the arm portion has a length selected such that when the cable connector housing is fully engaged to the board mount connector housing, the catch portion engages the back side of the board mount connector housing.

Embodiment 11 is an electrical cable connector comprising: a cable connector housing including a first set of electrical contacts and a latch channel; and a latch attached to the cable connector housing, the latch including: an arm portion disposed in the latch channel and including a pair of latch arms, the latch arms including opposing catch portions disposed at a front end thereof and being adapted to securely attach the cable connector to a mating connector by surrounding a protrusion inside a housing of the mating connector; a hinge portion extending from a back end of the arm portion; and an actuation portion extending generally upwardly from the hinge portion, wherein pressing down the actuation portion about the hinge portion splays the latch arms such that the catch portions are moved away from each other.

Embodiment 12 is the electrical cable connector of embodiment 11, wherein the latch channel includes a first recess disposed at a bottom thereof, and wherein the latch arms are slidably positioned in the first recess.

Embodiment 13 is the electrical cable connector of embodiment 12, wherein the first recess includes a rear portion and a front portion extending between the rear portion and a front surface of the connector housing, wherein the latch arms are slidably positioned in the rear portion, and wherein the front portion is configured to receive the protrusion.

Embodiment 14 is the electrical cable connector of embodiment 13, wherein a width of the front portion is smaller than a width of the rear portion.

Embodiment 15 is the electrical cable connector of embodiment 11, wherein the latch channel includes a second recess disposed at a bottom thereof and configured to receive a front end of the actuation portion.

Embodiment 16 is the electrical cable connector of embodiment 11, wherein the opposing catch portions include ramp surfaces disposed at a front end thereof and configured to splay the latch arms while receiving the protrusion.

Embodiment 17 is the electrical cable connector of embodiment 11, wherein the hinge portion is resilient.

Embodiment 18 is the electrical cable connector of embodiment 11, wherein the actuation portion includes ramp surfaces disposed at a front end thereof and configured to splay the latch arms while pressing down the actuation portion.

Embodiment 19 is a latching electrical cable connector assembly comprising: a cable connector housing including a first set of electrical contacts and a latch channel; a latch attached to the cable connector housing, the latch including: an arm portion disposed in the latch channel and including a pair of latch arms, the latch arms including opposing catch portions disposed at a front end thereof; a hinge portion extending from a back end of the arm portion; and an actuation portion extending generally upwardly from the hinge portion, wherein pressing down the actuation portion about the hinge portion splays the latch arms such that the catch portions are moved away from each other; and a board mount connector housing including a second set of electrical contacts and a protrusion, wherein the latch arms are adapted to securely attached the cable connector housing to the board mount connector housing by surrounding the protrusion such that the second set of electrical contacts is electrically connected to the first set of electrical contacts.

Embodiment 20 is the latching electrical cable connector assembly of embodiment 19, wherein the protrusion is defined by Small Form Factor (SFF) industry standard SFF-8482.

In each of the embodiments and implementations described herein, the various components of the electrical connector and elements thereof are formed of any suitable material. The materials are selected depending upon the intended application and may include both metals and non-metals (e.g., any one or combination of non-conductive materials including but not limited to polymers, glass, and ceramics). In one embodiment, electrically insulative components, such as, e.g., cable connector housings 102, 402 and 502, latches 104 and 404, plug portions 108, 408 and 508, and connector housing 202, are formed of a polymeric material by methods such as injection molding, extrusion, casting, machining, and the like, while electrically conductive components, such as, e.g., electrical contacts 106, 206, 248 and 506, and latch 504, are formed of metal by methods such as molding, casting, stamping, machining, and the like. Material selection will depend upon factors including, but not limited to, chemical exposure conditions, environmental exposure conditions including temperature and humidity conditions, flame-retardancy requirements, material strength, and rigidity, to name a few.

Unless otherwise indicated, all numbers expressing quantities, measurement of properties, and so forth used in the specification and claims are to be understood as being modified by the term "about". Accordingly, unless indicated to the contrary, the numerical parameters set forth in the specification and claims are approximations that can vary depending on the desired properties sought to be obtained by those skilled in the art utilizing the teachings of the present application. Not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, to the extent any numerical values are set forth in specific examples described herein, they are reported as precisely as reasonably possible. Any numerical value, however, may well contain errors associated with testing or measurement limitations.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the mechanical, electro-mechanical, and electrical arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An electrical cable connector comprising:

a cable connector housing including a first set of electrical contacts and a latch channel; and a latch attached to the cable connector housing, the latch including:

an arm portion disposed in the latch channel and including a pair of latch arms, the latch arms including opposing catch portions disposed at a front end thereof and being adapted to securely attach the cable connector to a mating connector by surrounding a protrusion inside a housing of the mating connector;

a hinge portion extending from a back end of the arm portion; and an actuation portion extending generally upwardly from the hinge portion, wherein pressing down the actuation portion pivots the actuation portion about the hinge portion and splays the latch arms such that the catch portions are moved away from each other.

2. The electrical cable connector of claim 1, wherein the latch channel includes a first recess disposed at a bottom thereof, and wherein the latch arms are slidably positioned in the first recess.

3. The electrical cable connector of claim 2, wherein the first recess includes a rear portion and a front portion extending between the rear portion and a front surface of the connector housing, wherein the latch arms are slidably positioned in the rear portion, and wherein the front portion is configured to receive the protrusion.

4. The electrical cable connector of claim 3, wherein a width of the front portion is smaller than a width of the rear portion.

5. The electrical cable connector of claim 1, wherein the latch channel includes a second recess disposed at a bottom thereof and configured to receive a front end of the actuation portion.

6. The electrical cable connector of claim 1, wherein the opposing catch portions include ramp surfaces disposed at a front end thereof and configured to splay the latch arms while receiving the protrusion.

7. The electrical cable connector of claim 1, wherein the hinge portion is resilient.

8. The electrical cable connector of claim 1, wherein the actuation portion includes ramp surfaces disposed at a front end thereof and configured to splay the latch arms while pressing down the actuation portion.

9. A latching electrical cable connector assembly comprising:

a cable connector housing including a first set of electrical contacts and a latch channel;

a latch attached to the cable connector housing, the latch including:

an arm portion disposed in the latch channel and including a pair of latch arms, the latch arms including opposing catch portions disposed at a front end thereof;

a hinge portion extending from a back end of the arm portion; and an actuation portion extending generally upwardly from the hinge portion, wherein pressing down the actuation portion pivots the actuation portion about the hinge portion and splays the latch arms such that the catch portions are moved away from each other; and a board mount connector housing including a second set of electrical contacts and a protrusion, wherein the latch arms are adapted to securely attached the cable connector housing to the board mount connector housing by surrounding the protrusion such that the second set of electrical contacts is electrically connected to the first set of electrical contacts.

10. The latching electrical cable connector assembly of claim 9, wherein the protrusion is compliant with Small Form Factor (SFF) industry standard SFF-8482.

* * * * *